US005331387A

United States Patent [19]

Okada et al.

[11] Patent Number: 5,331,387

[45] Date of Patent: Jul. 19, 1994

[54] PRINTING AND BINDING APPARATUS

[75] Inventors: Hisao Okada; Kunio Satoh, both of Hitachi; Takao Umeda, Mito, all of Japan

[73] Assignee: Hitachi, Ltd., Tokyo, Japan

[21] Appl. No.: 10,171

[22] Filed: Jan. 28, 1993

[30] Foreign Application Priority Data

Jan. 31, 1992 [JP] Japan ..... 4-015930

[51] Int. Cl.[5] ..... G03G 15/00; G03G 21/00

[52] U.S. Cl. ..... 355/324; 355/309; 355/310

[58] Field of Search ..... 355/77, 308, 309, 310, 355/311, 323, 324; 270/1.1, 37, 53; 101/93.07, 113, 117

[56] References Cited

U.S. PATENT DOCUMENTS

| | | | |
|---|---|---|---|
| 4,479,641 | 10/1984 | Bean et al. | 270/53 |
| 4,811,048 | 3/1989 | Ishikawa | 355/323 |
| 4,839,732 | 6/1989 | Murakami et al. | 355/310 X |
| 5,060,921 | 10/1991 | Higashio et al. | 270/53 |
| 5,085,417 | 2/1992 | Copham | 270/1.1 |

FOREIGN PATENT DOCUMENTS

| | | |
|---|---|---|
| 0041602 | 4/1981 | European Pat. Off. . |
| 0226233 | 10/1986 | European Pat. Off. . |
| 485000 | 10/1929 | Fed. Rep. of Germany . |

*Primary Examiner*—A. T. Grimley
*Assistant Examiner*—Sandra L. Brasé
*Attorney, Agent, or Firm*—Antonelli, Terry, Stout & Kraus

[57] ABSTRACT

A printing and binding system and method utilize an electrophotographic apparatus for performing a printing operation so that a plurality of booklets can be simultaneously printed and bound even if the quantity to be printed is not large. Rolled paper is cut in a pre-treatment portion i a direction in which the rolled paper is supplied, into sizes each corresponding to a desired booklet so as to prepare cut paper sheets, then the same pages of booklets of a number which can be printed are simultaneously printed on the cut paper sheets in a printing portion, and then the next pages of the booklets are sequentially printed on the next cut paper sheets. After the pages of a plurality of booklets which can be printed simultaneously have been printed, the printed paper sheets for a plurality of the booklets are conveyed to a post-treatment portion so as to be cut into individual booklets so that desired booklets are bound. If the required number of the booklets has not been bound, the aforesaid steps are repeated. The system thus constituted enables a plurality of booklets to be printed simultaneously and also enables the time taken to bound the booklets to be shortened.

10 Claims, 15 Drawing Sheets

PRINTING AND BINDING APPARATUS

BACKGROUND OF THE INVENTION

The present invention relates to a method and an apparatus for printing image information on printing paper by electrophotography and binding the printed paper into books.

Conventional printing and binding apparatuses are categorized into a type comprising a rotary press for printing and binding books and another type for printing and binding books by electrophotography. In particular, Japanese Patent Unexamined Publication No. 61-25889 and Japanese Patent Unexamined Publication No. 61-112694 have disclosed an apparatus of the aforesaid type for binding books from printing paper sheets in such a way that printing paper sheets are sequentially printed as it is or by spreading the book by the electrophotography and the recorded paper sheets are stapled and bound up. On the other hand, Japanese Patent Unexamined Publication No. 58-18293 has disclosed technology for making a plurality of business form booklets by printing a continuous business form in accordance with output information from a computer in such a way that the contents of pages of two or more booklets are printed in the widthwise direction of the continuous business form, and the widthwise directional side of the booklet is bound by a bookbinding apparatus such as a stitcher and the two or more booklets are made by cutting performed in a direction perpendicular to the side of the bound booklet. Although the time taken to complete the printing process can be shortened by employing the electrophotography, a problem arises that it takes an excessively long time to bind the books if a large number of books must be bound.

SUMMARY OF THE INVENTION

An object of the present invention is to provide a printing and binding method and an apparatus having an electrophotographic apparatus for performing a printing operation so that a plurality of booklets can be simultaneously printed and bound even if the quantity to be printed is not large.

In order to achieve the aforesaid object, the present invention employs the following method.

In order to simultaneously print and bind pages for a multiplicity of booklets, the same pages for a multiplicity of booklets are disposed in one printing paper sheet, the pages are printed in the page sequential order, the pages are cut and separated after all of the pages have been printed, and back sides are bonded and stapled so that books are manufactured. The method according to the present invention is able to manufacture booklets in units, the number of which is the booklets which can be included by one printing paper sheet, so that the time taken to complete the binding process can be shortened. In order to realize the aforesaid effect, the electrophotographic printer must be able to print a large area of the printing paper by a single printing operation thereof and a cutting machine capable of cutting and separating the booklets must be provided so as to serve as a processing apparatus to be operated after the printing operation has been completed.

DESCRIPTION OF THE PREFERRED EMBODIMENTS

Figure 1:
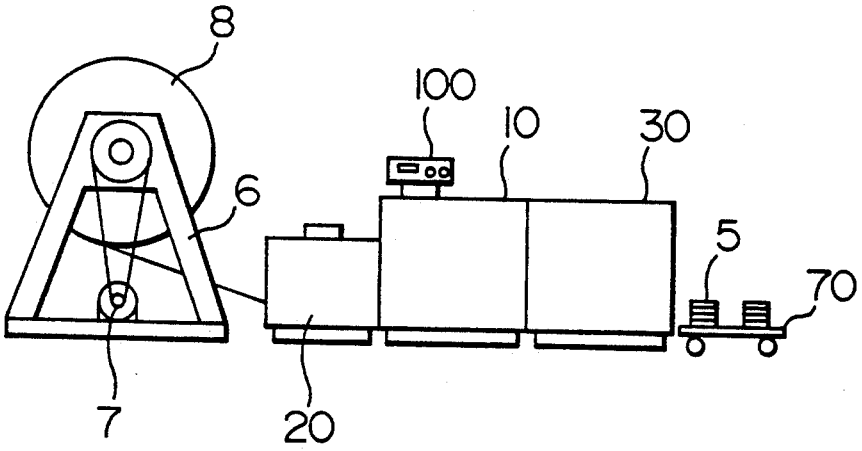
FIG. 1 illustrates the overall structure of a printing and binding apparatus according to the present invention.

Preferred embodiments of the present invention will now be described. FIG. 1 illustrates the overall structure of an embodiment of a printing and binding apparatus according to the present invention. Referring to FIG. 1, a roll of paper 8 is placed on a supporting portion 6 of the apparatus, and it is fed to a pre-treatment portion 20 by a feeding motor 7. In the pre-treatment portion 20, the unrolled portion of the rolled paper 8 is cut in the feeding direction to have a length of a desired booklet. Then, pages of a multiplicity of booklets are simultaneously printed in a printing portion 10 so as to be outputted to a post-treatment portion 30. The printing portion 10 comprises a control portion, with which data about printing, that about the number of the booklets to be made, that about the size of a page of the booklet and the like are inputted, the printing portion 10 further comprising a control unit 100 for controlling the overall portion of the apparatus. In the post-treatment portion 30, each booklet is made by cutting, and stapling and bonding of the back are performed so that the booklets are bound. The bound booklets 5 are outputted to a conveyance portion 70.

The procedure of printing and binding processes will now be described with reference to Figs. 2A to 2D. FIGS. 2A to 2D illustrate a process in which five booklets each having 100 pages are made in such a way that image information 4 of the same page of the five booklets are arranged laterally so as to be printed simultaneously.

(A) First, the unrolled portion of the rolled paper 8 is cut at a boundary 2 to have the size H of the booklet, and image information is printed in the sequential order of pages. For example, the unrolled portion of the rolled paper 8 is cut to have the longitudinal size of the booklet and the image information is printed in the order in which the page number decreases. The number given to each page shows the page number, while the number in parentheses shows the page number of the reverse side.

(B) The pages of the booklets are printed by the determined number.

(C) After the determined number of pages of the booklets have been printed, the pages are arranged so that a non-separated booklet 18 is made (in a state where five completed booklets are connected to one another in terms of the paper sequential order).

(D) The non-separated booklet 18 is sectioned at boundaries by cutting so that separated booklets 19 are made.

Then, each booklet 19 is bound by stapling and by bonding the back portion thereof so that the booklets are completed.

If a larger number of booklets must be made, the aforesaid steps (A) to (D) are repeated so that the operations of printing and binding booklets can be automatically performed.

Figure 2A:
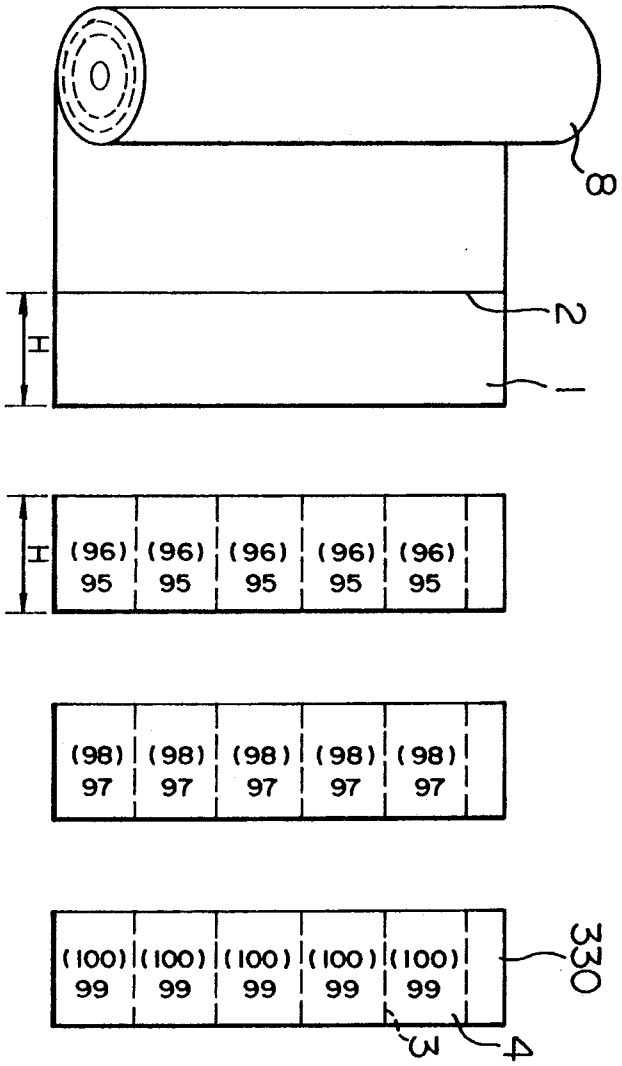
FIGS. 2A to 2D illustrate an example of the printing and binding procedure according to the present invention.
Figure 2B:
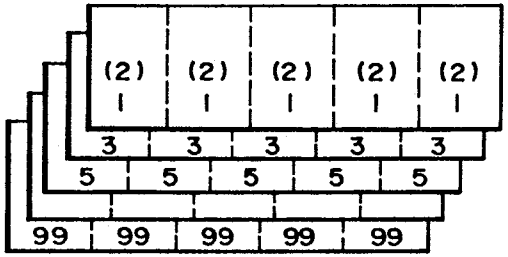
Figure 2C:
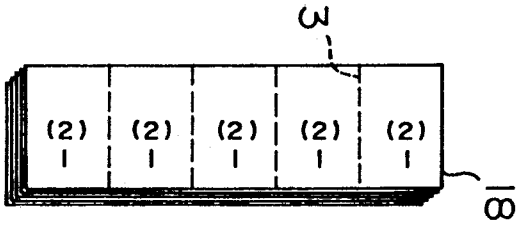
Figure 2D:
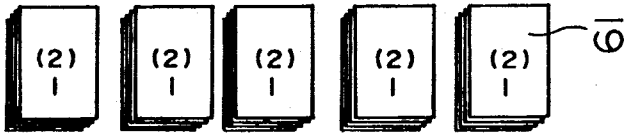

It should be noted that reference numeral 330 shown in FIG. 2A represents a margin created when 5 booklets are made from the printing paper and marginless printing is enabled by determining the lateral size of the booklet while considering the size of the rolled paper.

With the printing and binding apparatus thus constituted, a plurality of printed booklets can be simultaneously made and therefore an effect can be obtained in that time can be shortened to the time required to make one booklet, that is, the time can be shortened by a degree corresponding to the number of booklets which can be printed simultaneously as compared with the conventional method in which each booklet is printed or copied and then the printed sheets are bound.

Figure 3:
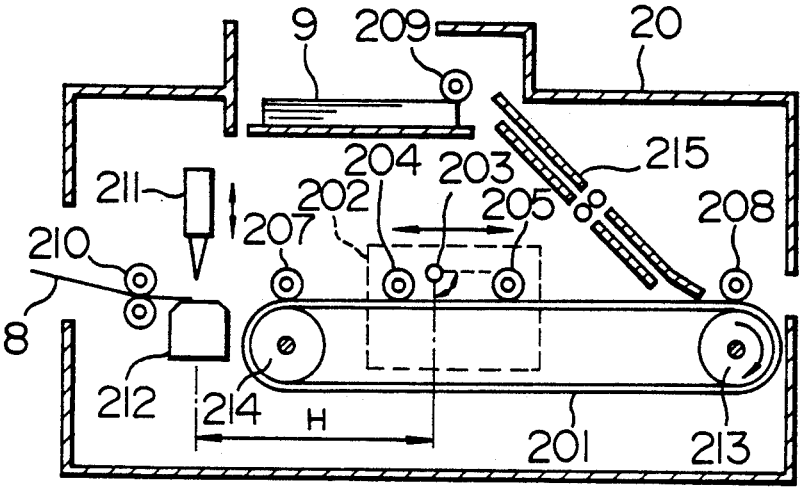
FIG. 3 illustrates the structure of an example of a pre-treatment portion according to the present invention.

FIG. 3 illustrates the structure of the pre-treatment portion 20. The pre-treatment portion 20 cuts the unrolled portion of the rolled paper 8 to have a predetermined length. Reference numeral 202 represents a restriction mechanism for restricting the length of the paper. The restriction mechanism 202 includes rollers 204 and 205 and a paper leading portion detection mechanism 203, and is movable in the lateral direction. The distance H from the blade of a cutter 211 to the paper leading portion detection mechanism 203 is set to the longitudinal or the lateral size of the booklet. The unrolled portion of the rolled paper 8 held between rollers 210 is conveyed to the right when the rollers 210 are rotated, and then it is held between a roller 207 and a conveyance belt 201 so that the unrolled portion of the roll paper 8 is further moved to the right. When the leading portion of the rolled paper 8 is detected by the paper leading portion detection mechanism 203, feeding of the unrolled portion of the rolled paper 8 is stopped. Then, the cutter 211 and a cutter backing member 212 are used to hold and cut the unrolled portion of the rolled paper 8. Then, the paper leading portion detection mechanism 203 is so evacuated as not to interrupt feeding of the paper 8. The cut paper sheets 8 are discharged from the pre-treatment portion 20 and are sent to the printing portion 10 while being held between the conveyance belt 201 and rollers 205 and 208. Incidentally, the conveyance belt 201 has drive rollers 213 and 214 on the two terminative ends thereof so as to be driven by a motor disposed to either of the rollers 213 and 214.

Since the size of the booklets varies widely, it is impossible to prepare the paper sheets of the subject size if the size of the booklet has not been determined previously. Although cut sheets of a regular size (for example, A4, A5, A6, B4, B5 or B6 regular sheets or the like) can be prepared, a space for storing the cut sheets is required, causing a problem to arise o 10 in the control facility. However, this embodiment is able to eliminate the necessity of preparing regular sheets, which have been cut to have the size of the booklet, because the rolled paper is cut to have a predetermined length of the subject booklet by the pre-treatment portion 20. Since booklets of an arbitrary size (for example, a size between A4 and A5) can be manufactured, books capable of meeting the current needs (for example, a tendency to make great account of individual information or character of a person) can be printed.

It should be noted that cut sheets 9 can be used in the pre-treatment portion 20 shown in FIG. 3. A roller 209 introduces the cut sheets 9 into the conveyance belt 201 via a paper guide 215 so that the cut sheets 9 are held between the roller 208 and the conveyance belt 210 so as to be discharged to the printing portion 10 through the pre-treatment portion 20.

It is preferred that cut sheets are used in the case where checking, proofreading of the printed contents or test printing is performed because the aforesaid processes can be completed by printing one booklet. In this case, cut sheets of a size in which the contents of one booklet can be sufficiently contained are used. If a rolled paper is used, it must be cut to have the desired sheet size, causing a problem to arise in that it takes an excessively long time to cut the sheets. Therefore, it is preferred that the paper feeding unit is installed so as to use the cut sheets in the case where only one booklet is printed and bound or the number of the booklets is too small to use the rolled paper.

Figure 4:
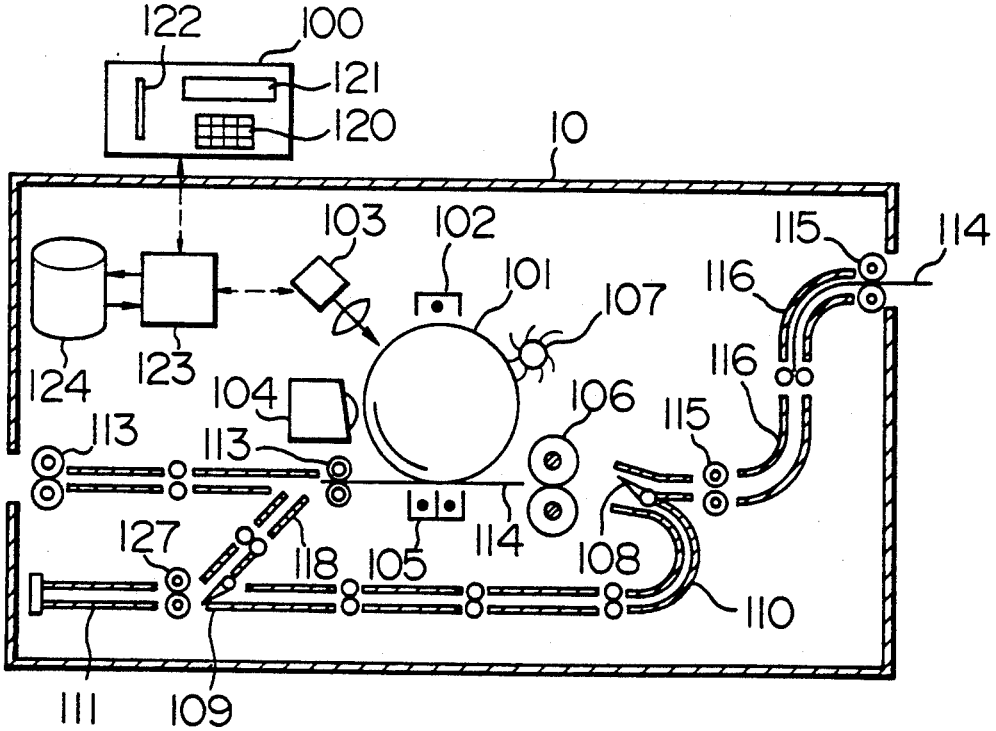
FIG. 4 illustrates the structure of an example of an electrophotographic printing portion according to the present invention.

FIG. 4 illustrates the structure of the printing portion 10. Specifically, the printing portion 10 comprises an electrophotographic recording printer. A paper sheet 114 supplied from the pre-treatment portion 20 is introduced into the printer through the left end portion of the printer shown in FIG. 4, the paper sheet 114 being then discharged to the right end portion of the apparatus shown in FIG. 4 after it has been printed, so that the paper sheet 114 is brought into the next step (the post-treatment portion 30). In the printer shown in FIG. 4, the surface of a photoconductive drum 101 is charged by a charger 102, and the surface is then exposed to light by an exposure unit 103 in accordance with image information so that a latent image is formed, the latent image being then formed into a toner image by a developing unit 104 so as to be visualized. The toner image is then transferred to the paper sheet 114 by a transfer unit 105, and the toner is melted and fixed to the paper sheet 114 by a fuser 106 so that the image is fixed to the paper sheet 114. Then, a portion of the toner left on the photoconductive drum 101 is removed by a cleaner 107, and the next printing process is repeated. Remarking the movement of the paper sheet 114, the paper 114 sent from the pre-treatment portion ° 20 is conveyed by rollers 113 so that the paper sheet 114 is inserted into a portion between the transfer unit 105 and the photoconductive drum 101. The toner image formed on the paper sheet 114 and transferred by the transfer unit 105 is fixed by the fuser 106, and then the paper sheet 114 is sent to the next process (the post-treatment portion 30). In the case where a one-side printing operation is performed, a paper passage change-over device 108 is changed over to a lower position so that the paper sheet 114 is sent to a paper discharge passage 116 by rollers 115 and the paper sheet 114 is sent to the next process. In the case where a double-side printing operation is performed, a relatively complicated process must be performed as compared with the case where the one-side printing operation is performed. If a command to perform the double-side printing operation has been issued from an input unit, the paper passage change-over device 108 is changed over to an upper position in conformity with the command issued from a control unit so that the paper sheet 114 passes through a paper inversion passage 110 so that the paper sheet 114 is introduced into a paper inversion portion 111 in which paper insertion rollers 127 are rotated inversely. Then, the paper change-over device 109 is changed over to a lower position so that the moving direction of the paper sheet 114 is inverted and the paper sheet 114 passes through a guide 118 so as to be again sent to the transfer unit in which the residual side of the paper sheet 114 is printed in the aforesaid printing sequence and then the paper sheet 114 is sent to the next process.

An image data process required to perform printing will now be described.

Commencement of the printing operation is instructed by the control unit 100. Data of image information to be printed has been stored by a storage medium (a magnetic disk, an optomagnetic disk, an optical disk or a semiconductor memory or the like), the stored image being then transferred to a storage medium input portion 122 and information about the printing and binding operation (for example, the total number of booklets desired to be manufactured, the size of each booklet, the number of image information items required for the number of the booklets to be simultaneously printed and the layout of each paper sheet to be printed simultaneously or instructed layout information) is inputted by using a key input portion 120. Furthermore, information about a fact whether the one-side printing operation or the double-side printing operation is performed is inputted. The results of the inputting operations are displayed on a display portion 121. If the information has been inputted correctly and the completion of the inputting operation has been confirmed, the commencement of the printing operation is instructed by using the key input portion 120 so that the printing operation is commenced. Reference numeral 123 represents a raster processor for developing printing data read from an external storage medium into dot data, and the exposure unit 103 exposes the photoconductive drum 101 in accordance with the aforesaid dot data.

In the case where a multiplicity of booklets (for example, 100 booklets) are made, the embodiment of the present invention is arranged to print and bind them in units of five booklets in order to reduce the space required to place the paper sheets or to meet a requirement made by a customer (a requirement of sample delivery for example). In this case, a process of developing the same printing data into dot data for each of the five booklets must be repeated, resulting in that the processing time is wasted if the same printing data is used except for a case where correction of a misprint is performed. The degree of the waste of the processing time becomes excessive if the time taken to develop the printing data into the dot data is longer than the time taken to print one page, as for example, where the printing data is precise graphic data or image data such as a photograph having a great quantity of information. If data having a great quantity of information is developed into dot data whenever the printing operation is performed, the printing operation cannot be commenced and therefore the printing process is stopped, causing the throughput of the printing and binding system to deteriorate. Therefore, a high-speed storage unit 124 revealing high access speed is provided for the printing portion 10 so that the developed dot data is stored in the high speed storage unit 124 from which the stored dot data is used as exposure data from the moment the same page is again printed. As a result, the stoppage of the printing operation in the ensuing printing operation can be prevented and therefore the throughput can be improved. If the developed dot data is stored as described above, the correction of a misprint can be performed by using the aforesaid high speed storage unit in the case where the quantity of correction is not excessively large, causing an effect to be obtained in that the necessity of again developing the dot data can be eliminated.

Figure 5:
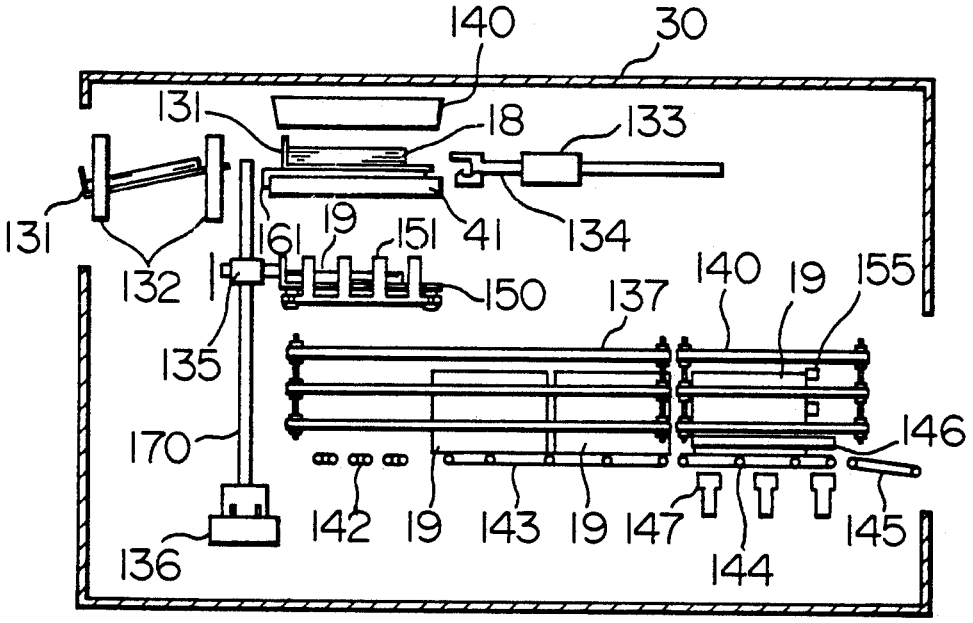
FIG. 5 illustrates the structure of an example of a post-treatment portion according to the present invention.
Figure 6A:
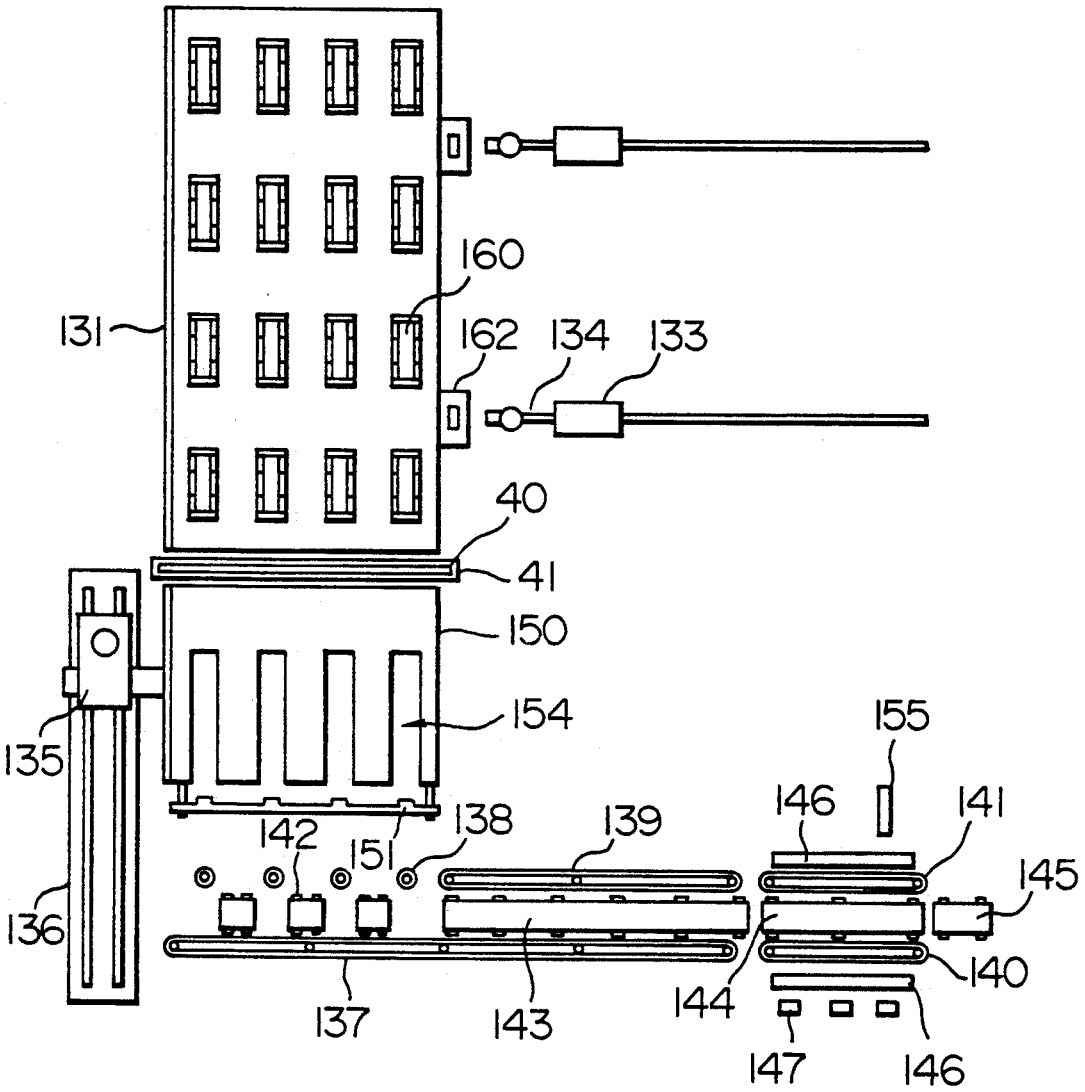
FIGS. 6A and 6B illustrate another example of the mechanism of the post-treatment portion according to the present invention.
Figure 6B:
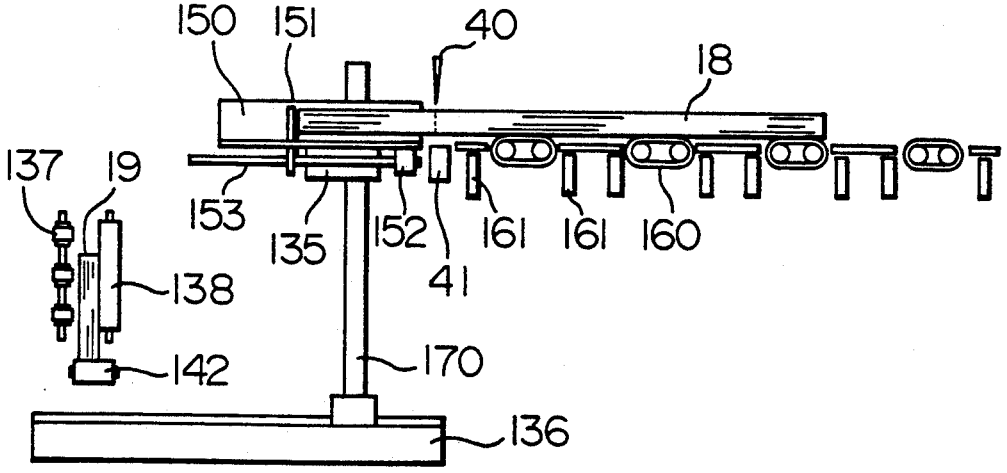

FIG. 5 illustrates the mechanism of the post-treatment portion 30. FIG. 6A is a plan view which illustrates the mechanism shown in FIG. 5 when viewed from an upper position. FIG. 6B is a side elevational view which illustrates the mechanism shown in FIG. 5 from a right position. In order to simplify the illustration, the booklets are omitted from FIG. 6A. In the post-treatment portion 30, the printed sheets are accommodated in a stacker 131, and a stacker horizontal movement arm 134 holds a stacker handle portion 162 of the stacker 131 after printing of pages for one booklet has been completed, causing the stacker 131 to be moved to the upper surface of a stacker holding frame 161. The stacker horizontal movement arm 134 is horizontally moved by an arm drive mechanism 1-33. A plurality of stackers 131 are prepared so as to be used so that, if one stacker 131 is placed on the stacker holding frame 161, the residual stackers 131 are used to accommodate the printed paper. Thus, the printing operation can be continued. The procedure of changing the stackers 131 will be described later. Non-separated booklets 18 accommodated in the stacker 131 placed on the stacker holding frame 161 are moved in a direction perpendicular to the drawing sheet by a distance of the width of one booklet so that it is placed on a conveyance stacker 150, the movement being enabled by a booklet conveyance belt 160. A booklet width restriction stopper 151 is moved perpendicular to the drawing sheet so as to restrict the quantity of the conveyance from the stacker 131 to the width of one booklet. The non-separated booklets 18 are held between a cutter 40 and a cutter backing member 41 so as to be separated by cutting so that separated booklets 19 are made. The conveyance stacker 150 is vertically moved and rotated by a conveyance stacker movement mechanism and the same is also moved on a rail 136 in a direction perpendicular to the drawing sheet. The booklet 19 on the conveyance stacker 150 is conveyed to a position between a guide belt 137 and a guide rail 138 shown in FIG. 6. The booklet 19 is conveyed by conveyance belts 142, 143 and 144 while being guided by the guide belts 137 and 139 and the guide rail 138, and then the booklet 19 is restricted by a booklet leading portion restriction stopper 155 so that it is stopped on the conveyance belt 144. The booklet 19 is arranged on the conveyance belt 144, and then the same is bound by a booklet binder 17. When the booklet 19 has been bound, the conveyance belts 144 and 145 are operated so that bound booklet is discharged from the post-treatment portion 30.

Figure 7A:
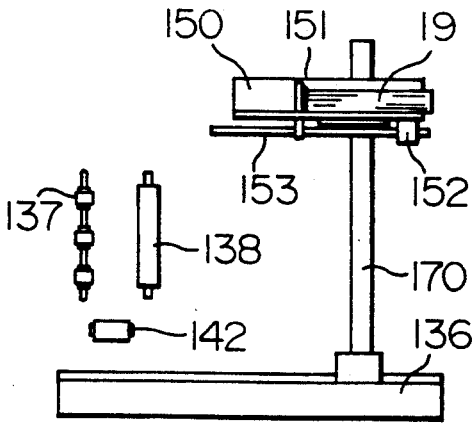
FIGS. 7A to 7F illustrate a procedure of conveying the paper sheet according to the present invention.
Figure 7B:
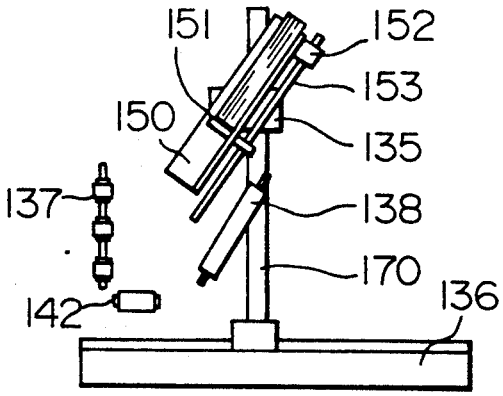
Figure 7C:
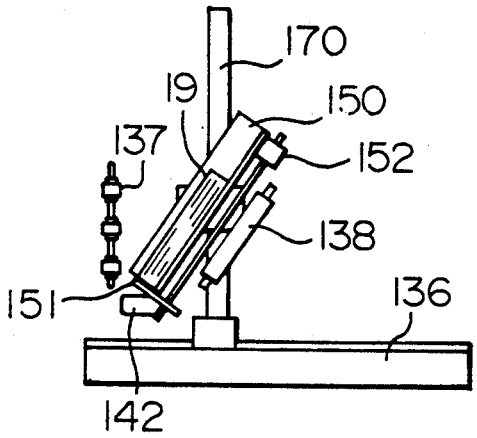
Figure 7D:
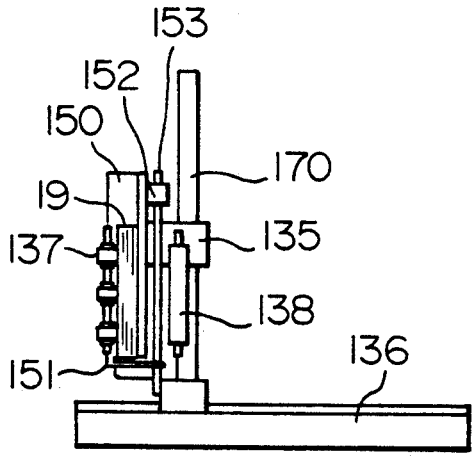
Figure 7E:
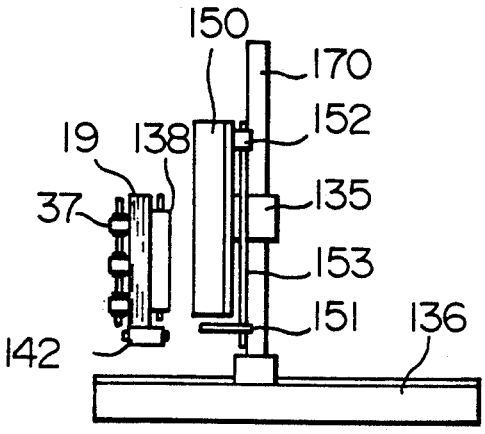
Figure 7F:
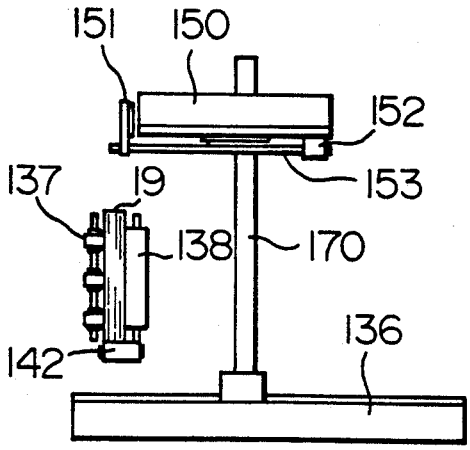

FIG. 7A to 7F illustrate the operation procedure of conveying the booklets 19 separated by the cutter 40 to a position between the guide belt 137 and the guide rollers 138. As shown in FIGS. 7A to 7F, the conveyance stacker movement mechanism 135 rotates the conveyance stacker 150 and vertically moves a support column 170. Also the support column 170 is laterally moved on the rail 136. The aforesaid two types of movement enable the conveyance stacker 150 to be moved to the position between the guide belt 137 and the guide rollers 138. The procedure will now be described. FIG. 7A illustrates a state immediately after the booklets 19 have been cut. Then, the guide roller 138 is evacuated, and the conveyance stacker 150 is inclined as shown in FIG. 7B. Then, the left end of the conveyance stacker 150 is, as shown in FIG. 7C, allowed to come closer to the conveyance belt 142, and the booklet width restriction stopper 151 is shifted to the lower left position so that the separated booklet 19 is slid to the lower left position. The movement of the booklet width restriction stopper 151 is enabled by a thread formed in a booklet width restriction stopper movement shaft 153 and by a thread formed in the booklet width restriction stopper 151 when the booklet width restriction stopper movement shaft 153 is rotated by a booklet width restriction stopper shaft rotating machine 152. Then, the conveyance stacker 150 is stood erect as shown in FIG. 7D. Then, the evacuated guide roller 138 is, as shown in FIG. 7E, caused to pass through a conveyance stacker slot 154 so that the separated booklet 19 is held and the conveyance stacker 150 is shifted to the right. Finally, the conveyance stacker 150 is again restored to the horizontal attitude, causing the original state to be realized as shown in FIG. 7F. Then, the aforesaid operations are repeated by a required number of times.

Figure 8A:
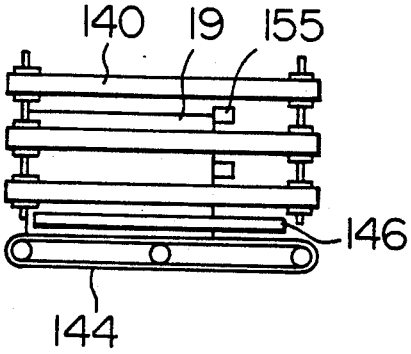
FIGS. 8A to 8E illustrate a procedure of binding booklets according to the present invention.
Figure 8B:
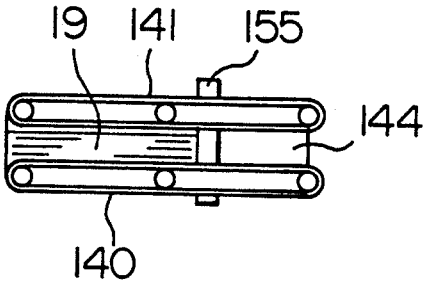
Figure 8C:
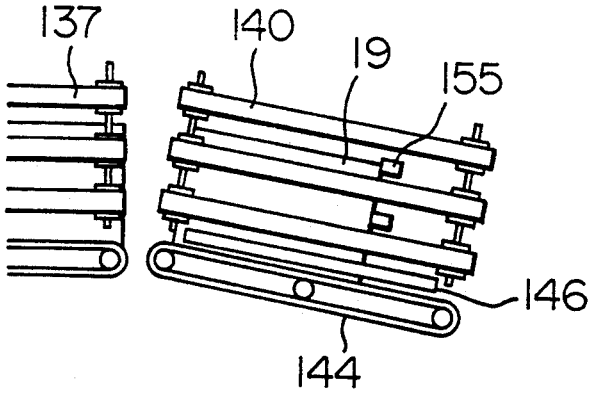
Figure 8D:
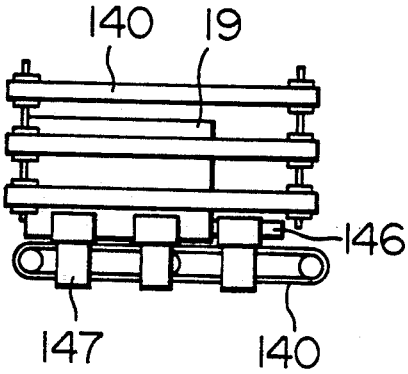
Figure 8E:
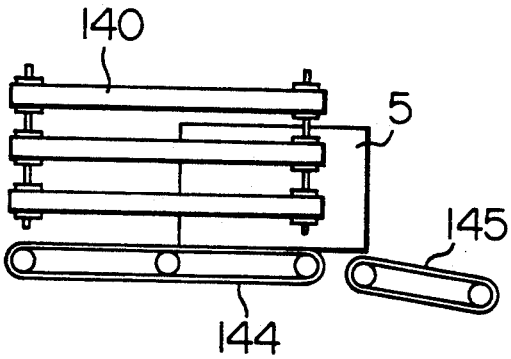

FIGS. 8A to 8E illustrate the procedure of bookbinding. Referring to FIG. 8A, the separated booklet 19 conveyed by the conveyance belt 144 is stopped by the booklet leading portion restriction stopper 155 and the lower binding position of the separated booklet 19 is held and arranged by a booklet holder 146. FIG. 8B is a top view. Two guide belts 140 and 141 hold the separated booklet 19 to arrange the two vertical ends of the separated booklet 19. As shown in FIG. 8C, the overall body of the mechanism which is holding the separated booklet 19 is inclined toward the booklet leading portion restriction stopper 155. As a result, the lateral ends of the separated booklet 19 are arranged. At this time, the guide belts 140 and 141 and the booklet holder 146 are somewhat loose so as to enable each sheet of the separated booklet 19 to be moved easily. Then, the binding positions of the separated booklet 19 are bound by a booklet binder 147 as shown in FIG. 8D so that the book binding operation is completed. Then, the booklet 5 is discharged by operating the conveyance belts 144 and 145 as shown in FIG. 8E.

Figure 9A:
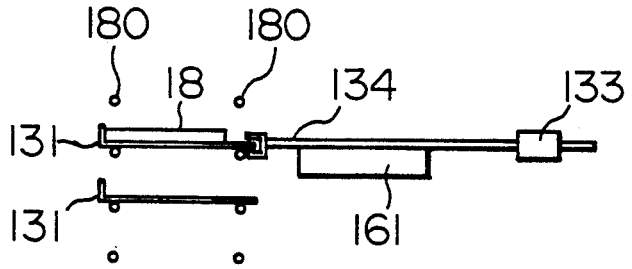
FIGS. 9A to 9D illustrate a stacker conveyance mechanism.
Figure 9B:
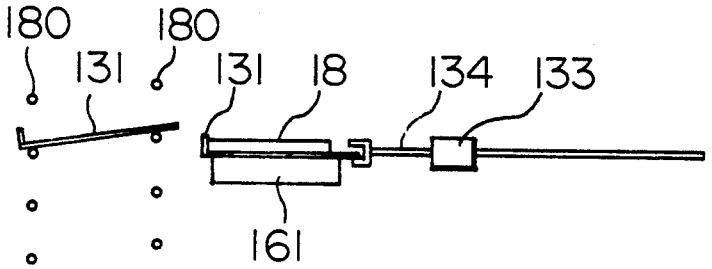
Figure 9C:
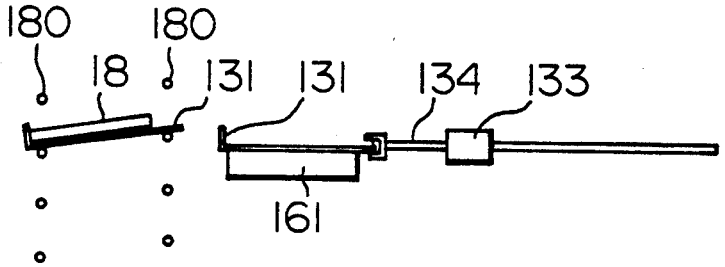
Figure 9D:
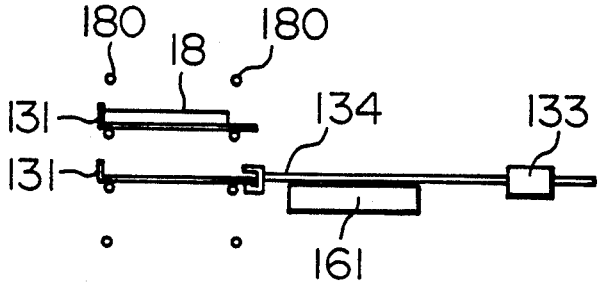

FIGS. 9A to 9D illustrate the procedure of changing the stacker 131. FIG. 9A illustrates a state where the non-separated booklet 18, the pages of which have been printed, has been accommodated by the stacker 131, and the stacker 131 is held horizontally. The stacker movement arm 134 is sent by the arm drive mechanism 133, and the stacker 131 is held by the stacker movement arm 134. The stacker 131 has a stacker handle portion 162 as shown in FIG. 6A. Then, the stacker 131 is pulled so as to be placed on the stacker holding frame 161 as shown in FIG. 9B, and the blank stacker 131 and stacker holding pin plates 181 are moved to an immediately upper paper stacking position. At this time, the vertical directional relationship between the two stacker holding pin plates 181 is slightly deviated so as to cause the left end position of the stacker 131 to be positioned downwards. Thus, the paper sheets discharged from the printing portion 10 can easily be arranged. FIG. 9C illustrates a state where no booklet is placed on the stacker 131 positioned on the stacker holding frame 11 and the next non-separated booklet 18 is placed on the stacker 131 supported by stacker holding pins 180. Then, the stacker holding pins 180 are shifted to the immediately upper position, and the blank stacker 131 placed on the stacker holding frame 161 is sent to the left by the stacker movement arm 134 as shown in FIG. 9D. Then, the stacker holding pins 180 are moved to the immediately lower position, causing the state shown in FIG. 9A to be again realized. Thus, the stacker 131 can be changed. By preparing a plurality of the stackers 131 so as to be used for accommodating and cutting the printed paper sheets, the wasteful waiting time for the next printing operation taken until the cutting operation is completed can be prevented and therefore the deterioration of the throughput of the printing and binding system according to the present invention can be prevented.

Figure 10:
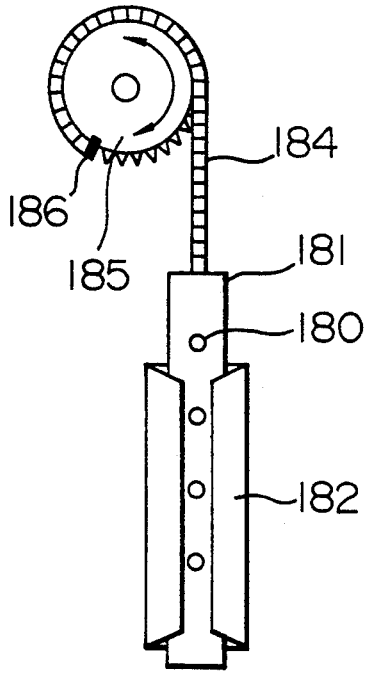
FIG. 10 illustrates a mechanism for vertically moving the stacker.

FIG. 10 illustrates a mechanism for vertically moving the stackers 131. The stacker holding pins 180 are pins fastened to the stacker holding pin plate 181 which is held by a guide plate 182 and which is connected to a chain 184. The chain 184 is secured to a chain winder 185 at a chain securing portion 186 thereof. When the chain winder 185 is rotated, the stacker holding pin plate 181 can be moved vertically.

Figure 11:
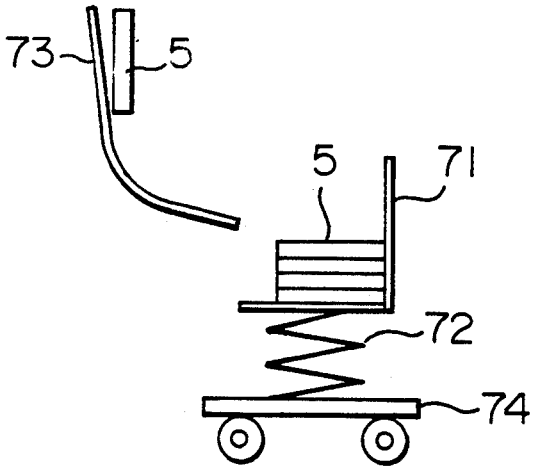
FIG. 11 illustrates an apparatus for discharging and stacking the booklets.

FIG. 11 illustrates an apparatus for accumulating the bound booklets 5. FIG. 11 illustrates the post-treatment portion 30 shown in FIG. 5 when viewed from a right position. The bound booklets 5 discharged from the post-treatment portion 30 are slipped downwards while being guided by a booklet guide 73, and the booklets 5 are stacked on a booklet stacker 71. A spring 72 is contracted while corresponding to the weight of the stacked booklets 5, and a predetermined number of the stacked booklets 5 are carried by a carrier car 74 and an empty carrier car 74 is brought to the subject position.

As described above, a multiplicity of booklets can be manufactured in a time relatively shorter than the time taken with the conventional structure by simultaneously printing the same pages of a multiplicity of the booklets in the sequential order of the pages and by cutting and binding them so as to make individual booklets. Although this embodiment has an arrangement that the unrolled portion of the rolled paper is cut in the feeding direction thereof to have the longitudinal or the lateral size of the booklet so as to make cut sheets, the unrolled portion of the rolled paper may be printed as it is and cutting in the feeding direction and cutting to make each booklet may be performed after printing has been performed. As an alternative to this, the unrolled portion of the rolled paper may be first cut to have the widths of the booklets and the feeding 10 direction of the unrolled portion of the rolled paper may be cut after printing has been performed so as to make each booklet.

The operation of each mechanism can be controlled by a sequencer or a microprocessor, and the overall operation of the apparatus can be controlled by the control unit 100 by enabling control signals to be. transmissible among the pre-treatment portion 2, the printing portion 10, the post-treatment portion 30, the booklet carrier car 74 and the holding frame 6 when they are connected to one another.

Figure 12:
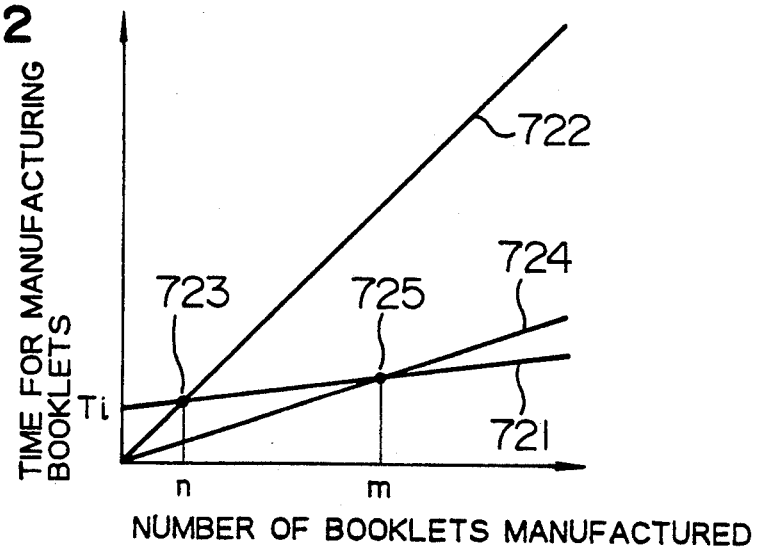
FIG. 12 is a graph which shows the relationship between the number of manufactured booklets and the time taken to manufacture them.
Figure 13A:
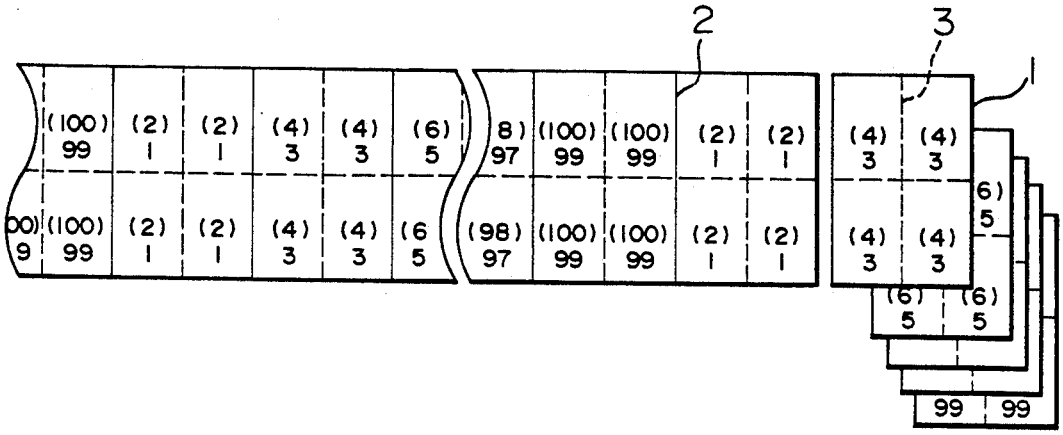
FIGS. 13A to 13D illustrate another example of the printing and binding procedure according to the present invention.
Figure 13B:
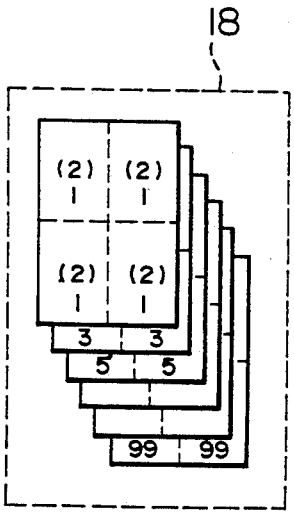
Figure 13C:
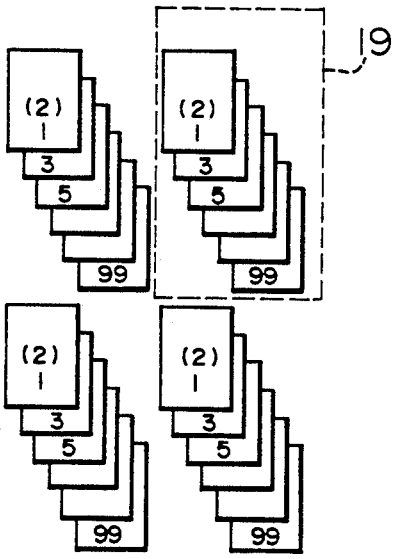
Figure 13D:
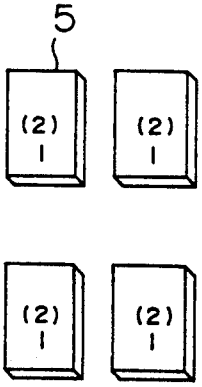

FIG. 12 is a graph which shows the relationship between the number of the manufactured booklets and time taken to manufacture them, where the axis of the abscissa stands for the number of the manufactured booklets and the axis of the ordinate stands for the time taken to manufacture them. A straight line 721 shows the relationship realized when a rotary press is used, resulting in that the time taken to manufacture the booklets is the sum of time Ti required to make a block copy and the time which takes to bind the booklets and which it is in proportion to the number of booklets to be manufactured. A straight line 722 shows the relationship realized when an electrophotography printer is used, resulting in that the time taken to manufacture the booklets is simply in proportion to the number of the booklets to be manufactured. A straight line 724 shows the relationship realized when printing, folding and gathering can be completed quickly, resulting in that the slope is moderate as compared with the straight line 722 because the time taken to bind one booklet can be shortened. An intersection of the straight lines 721 and 722 is an intersection of the rotary press and the electrophotographic method. Assuming that the number of the booklets at the intersection 723 is n, it can be understood from FIG. 12 that the efficiency can be improved by employing the electrophotography if the number is smaller than n and that it can be improved by employing the rotary press if the number is larger than n. If n is enlarged to bring the slope of the straight line 722 closer to the slope of the straight line 724, that is, to shorten the time required for the electrophotographic method to complete printing, the advantage obtainable from performing printing and binding by the electrophotographic method can be improved. Referring to the graph shown in FIG. 12, it is necessary for an intersection 725 to be present in a region in which the number of the booklets is larger than n ($m>n$) by moderating the slope of the straight line 722 (electrophotographic method) to be brought closer to the slope of the straight line 721 (rotary press).

Another embodiment of the present invention will now be described.

Figure 18:
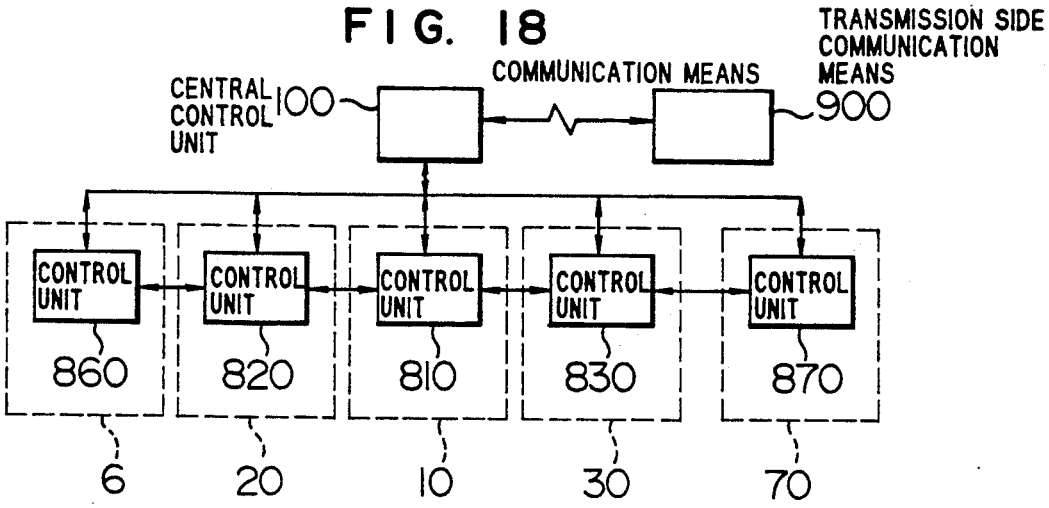
FIG. 18 illustrates the relationship between the mechanisms and the control portions of the present invention.

FIG. 18 is a block diagram which illustrates the relationship among the control systems of the control unit. Referring to FIG. 18, the mechanism portions, namely, the pre-treatment portion 20, the printing portion 10, the post-treatment portion, the booklet carrier car 70 and the holding frame 6 are provided with corresponding control units 820, 810, 830, 870 and 860. The adjacent mechanism portions transmit/receive control signals so as to be operated in synchronization with each other while holding a sequential operation relationship.

For example, the pre-treatment portion 20 and the printing portion 10 are arranged to transmit a signal denoting that the printing portion 10 has no paper sheet to be printed from the printing portion control unit 810 to the pre-treatment portion control unit 820 so that the paper sheets are conveyed from the pre-treatment portion to the printing portion 10. The central control portion 100 transmits/receives control signals to and from each mechanism portion so as to instruct and control the overall operation of the apparatus. The residual portions similarly transmit/receive control signals so that processing timing is synchronized among the portions. As a result, the overall apparatus is enabled to be smoothly operated under the control of the central control unit 100. Furthermore, state signals of the apparatuses are, as well as the control signals, transmitted/-received between the portions and between each portion and the central control unit so that the apparatus is controlled including information about the trouble of the apparatus. The state signals are exemplified by an abnormal signal denoting a paper jam. The state of the abnormality can be displayed and/or warned on the display panel of the operation portion.

The transmission and receipt of the signals among the portions can easily be performed by establishing an electrical signal connection. Although the movable booklet carrier car 70 and the post-treatment processing portion 30 can be connected by an electric signal connection, the handling facility can be improved if a non-contact type means such as infrared rays, electric waves or ultrasonic waves is employed.

The central control unit 100 is able to perform a role as a user interface as well as a role to instruct and control the overall operation. For example, the user interface is able to predict the time taken for each portion to perform the printing and binding operation and transmit it to the operation portion so as to successively notice the state of the printing operation which is being performed. Thus, information which enables a user to easily prepare for the operation can be transmitted outwards.

For example, in a case where 100 booklets are manufactured and the same pages for 5 booklets are simultaneously printed, measurement of time $t_5$ taken to print and bind the first 5 booklets enables the residual time taken to manufacture the residual 95 booklets to be predicted from the following equation:

$$t_{95}=19\cdot t_5 \quad (1)$$

By displaying the predicted time, the user is able to know when a preparation for the next printing operation must be made. Therefore, it is convenient because the user is able to make an operation schedule or control the stock of the paper sheets. In another case where data about information of an image to be printed is transmitted from a transmission side communication means 900 such as a modem to the central control unit 100 via a communication line, the time, at which the current printing operation is completed in the printing and binding apparatus, is transmitted to the data transmission side apparatus so that the transmission side operator is able to determine the time at which the transmission of the data about information of an image to be printed is commenced. That is, the necessity for the transmission side operator to monitor the operation of the printing and binding apparatus and the state of the printing operation, which is being performed, can be eliminated, causing an effect to be obtained in that the load required to perform the monitoring operation can be eliminated and therefore a necessity of using a high-performance control unit can be eliminated.

Even if the operation of printing the five booklets has not been completed, the predicted printing operation commencement time may be transmitted together with information about the current state of the operation performed by the printing and binding apparatus. If the printing and/or the binding operation is interrupted due to occurrence of a trouble such as a paper jam or the like during the printing or the binding process, only the period, in which the operation has been interrupted, may be displayed and transmitted or the completion time obtained by adding the interruption time may be displayed and transmitted. The data transmission may be performed whenever trouble takes place or when a request is made by the data transmission side operator.

FIGS. 13A to 13D illustrate the printing and binding procedure according to the present invention when a 100-page book is manufactured. The printing operation is performed by using an electrophotographic printer of a type which is capable of printing the two sides of a printing paper sheet 1. In this example, the same pages for four booklets are printed on one sheet or a unit of the printing paper sheet 1. Reference numeral 1 represents the printing sheet, and 2 represents a boundary of the printing sheet. The interval between the boundaries 2 of the cut sheets is determined depending upon the cutting size because the cut sheets have been separated previously, while the same of form paper corresponds to perforations. In the case of the rolled paper, it depends upon the structure of the photoconductive member of the electrophotographic printer. That is, if the photoconductive member is formed into an endless form (seamless), the interval is determined by software which controls the printing operation or determined depending upon the size of the stacker on which the printed paper sheet are stacked. If the rolled paper is used, its length along the photosensitive member excluding the seam becomes the boundary of the printing paper sheets in the case where the photosensitive member is a winding type member (having seams). Dashed line 3 shows the boundaries at which booklets are made by cutting. Reference numeral 5 represents manufactured books. The number given to the page of the printing paper sheet 1 denotes the page number of the book. The number in parentheses denotes the page number of the reverse side.

The printing and binding operation shown in FIG. 13 is performed in accordance with the following procedure.

(Process 1) Printing

The same pages of four books are printed in the sequential order of the pages. The printing paper sheets are stacked on the stacker while being arranged in the page sequential order.

(Process 2) Cutting and Gathering

Non-separated printed booklets 18 are separated from one another at the boundaries 3 by cutting so that non-bound booklets 19 are manufactured.

(Process 3) Binding

One book 19 is stapled or its back side is bonded so that four books are manufactured.

By repeating the aforesaid processes 1 to 3, a required number of books can be manufactured. As described above, a plurality of books can be printed and bound simultaneously by using the electrophotographic printer and by printing a plurality of books simultaneously and by cutting and binding them into individual books. FIG. 12 is a graph which shows the relationship between the number of books to be manufactured and the time taken to manufacture them, in which the straight line 722 is a conventional manufacturing performance line and the straight line 724 is a manufacturing performance line of the apparatus according to the present invention.

Figure 14A:
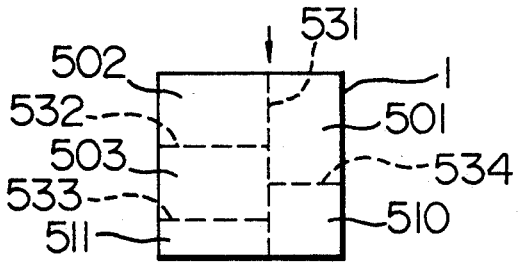
FIGS. 14A to 14C illustrate a procedure of disposing the pages in the printing paper sheet and that of cutting them.
Figure 14B:
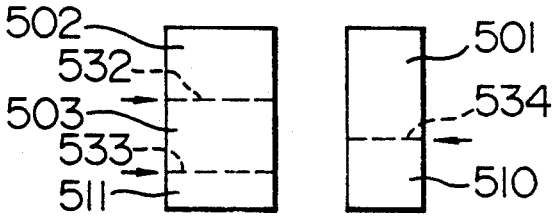
Figure 14C:
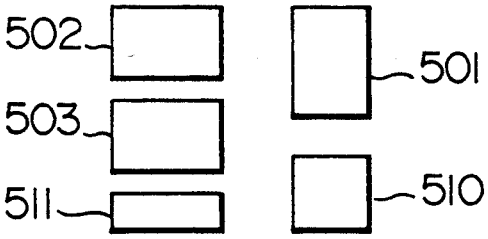
Figure 15:
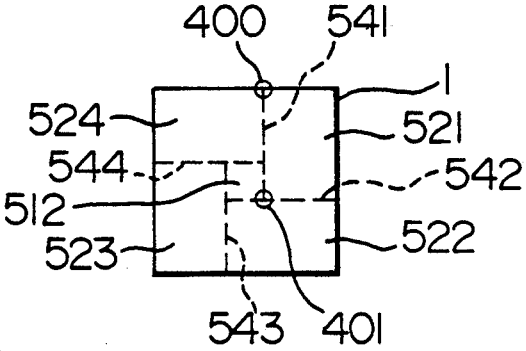
FIG. 15 illustrates a page configuration inhibited in the present invention.

FIG. 15 illustrates an example in which the booklets are so disposed as to eliminate the margin of the paper sheet. Since a margin 512 can be decreased as compared with the configuration shown in FIGS. 14A to 14C, the efficiency of using the printing paper sheet 1 can be improved. However, the fact that cutting lines 541, 542, 543 and 544 do not reach the two terminative ends of the printing paper sheet 1 causes a paper cutting means (for example, a cutter) to push asides the cut portion of the printing paper sheet 1 while cutting the printing paper sheet 1 because of the thickness of the blade if the printing paper sheet 1 is cut from an end 400 to an inside intersection 401 of the cutting line. Hence, if cutting is intended to be stopped at the intersection 401, the blade passes the intersection 401 and undesirably cuts the booklet 522. Therefore, the configuration shown in FIG. 15 must be avoided (inhibited) if possible.

The rule for arranging the booklets on the paper sheet is made as follows: assuming that a cutting line, at least either end of which is terminated inside the paper sheet, is a half cutting line and a cutting line, the two ends of which reach the terminative ends of the paper sheet, is a full cutting line, the pages must be so arranged that the intersection is not made by the two half cutting lines.

Applying the aforesaid rule to the example shown in FIGS. 14A to 14C, cutting lines 532, 533 and 534 are full cutting lines which respectively intersect a full cutting line 531 and the cutting lines 532, 533 and 534 are made to be full cutting lines after the paper sheet has been cut at the full cutting line 531. On the other hand, the cutting lines 541, 542, 543 and 544 intersect while being in the form of half cutting lines and therefore it is difficult to cut and separate the booklets 521, 522, 523 and 524 from one another because of the aforesaid reason. However, the breakage of the other booklet taken at the intersection 401 can be prevented if each boundary of the booklets is given a wide space at the time of cutting and then the peripheral portion is cut away, or if the margin 512 is cut out in a way similar to that for forming a mortise hole in timber and the booklets are sectioned by cutting. As described above, the working efficiency, the workability and the work realizability depend upon the configuration of printing data to be printed simultaneously. The mechanical working process must be performed with a trouble-less, reliable and safety apparatus or system. In this viewpoint, the present invention is an advantageous idea.

Figure 16:
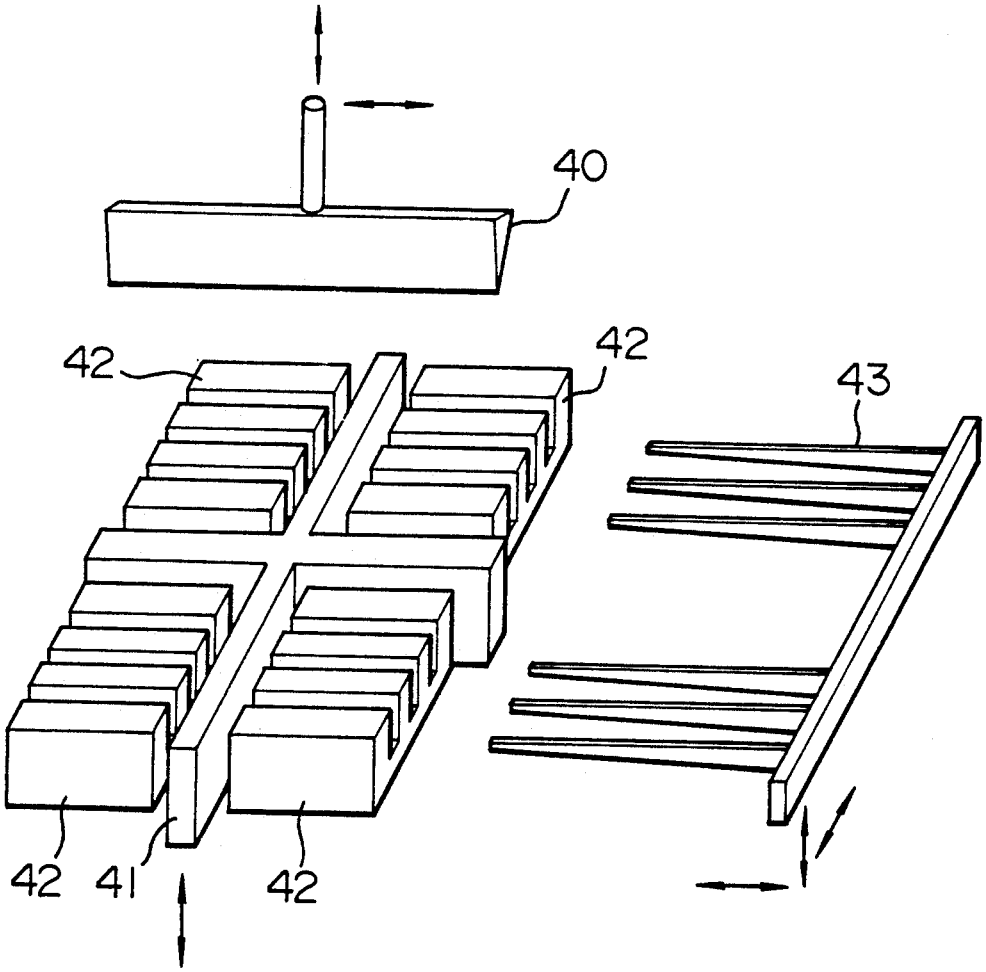
FIG. 16 illustrates an example of a cutting machine according to the present invention.
Figure 17A:
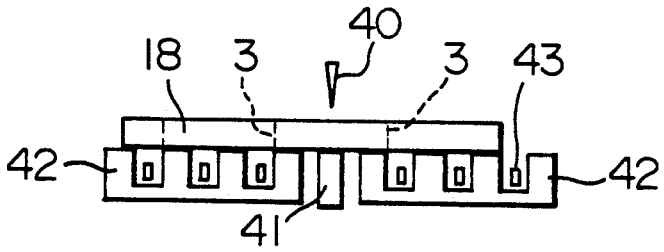
FIGS. 17A to 17G illustrate the operation of the cutting machine according to the present invention.
Figure 17B:
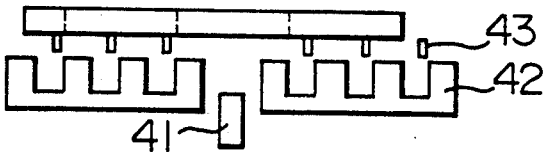
Figure 17C:
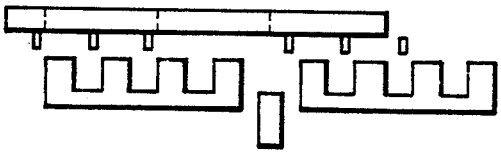
Figure 17D:
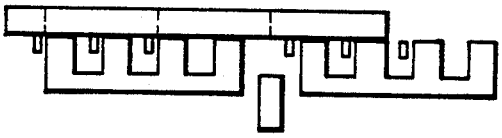
Figure 17E:
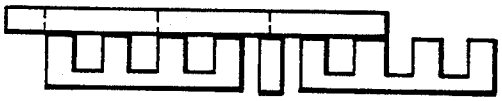
Figure 17F:
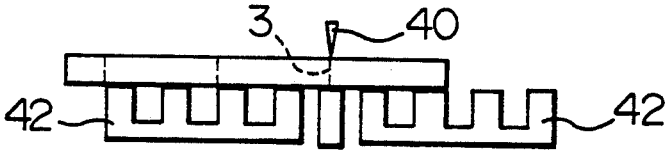
Figure 17G:
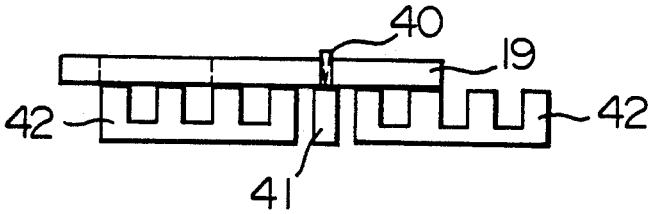

FIG. 16 illustrates another embodiment of the cutting machine. Reference numeral 40 represents a cutter, 41 represents a cutter backing member, 42 represents a holding frame on which printed paper sheets are placed, and 43 represents a lift for moving the printing paper sheets. The cutter 40 is able to move vertically and rotate, the cutter backing member 41 is able to move vertically, and the lift 43 is able to move vertically, laterally and longitudinally. A procedure of cutting one booklet by using the aforesaid cutting machine will now be described with reference to Figs. 17A to 17G. Referring to FIGS. 17A to 17G, reference numeral 16 represents a non-separated booklet composed of stacked pages of one booklet. Reference numeral 3 represents a boundary of the booklet to be separated. If the boundary 3 of the booklets 18 is not present under the cutter 40, the left 43 is inserted into a groove of the holding frame 42 to lift the non-separated booklet 18. Simultaneously, the cutter backing member 41 is lowered. The lift 43 is moved laterally so as to bring the boundary 3 of the booklets 18 to a position below the cutter 40. Then, the lift 43 is lowered to mount the non-separated booklet 18 on the holding frame 42, and the lift 43 is drawn out. Then, the cutter backing member 41 is raised to push the non-separated booklet 18 from the reverse side. Then, the cutter 40 is lowered to cut and separate the non-separated booklet 18. Thus, one non-bound booklet 19 is separated. Thus, the cutting operation of the cutting machine is performed. In a case where the non-separated booklet 18 is cut along a cutting line perpendicular to the cutting line 3 shown in FIGS. 17A to 17G, the cutter 40 is rotated by an angular degree of 90° the lift 43 is inserted into a groove of the holding frame 42, the non-separated booklet 18 is raised, and it is moved in a direction perpendicular to the drawing sheet so as to bring the cutting line to a position below the cutter 40.

By using the cutting machine according to the present invention, the booklets can be cut and separated at the boundary if the arrangement shown in FIGS. 14A to 14C and according to the aforesaid configuration rule is employed.

According to the present invention, even if an electrophotographic printer is used to perform the printing operation, a multiplicity of booklets can be printed and bound in a considerably short time which is a fraction of the time taken in the case where the conventional structure is used because the present invention has an arrangement that the same pages of a multiplicity of booklets are simultaneously printed in the page sequential order on one printing paper sheet or on a unit of printing paper sheets, and the booklets are cut and separated from one another after the pages for each booklet have been printed. The data to be printed may be processed by a word processor. As an alternative to this, a completed booklet may be read by an image scanner so as to make a multiplicity of copies, resulting in a similar effect to be obtained. Although the aforesaid embodiment has an arrangement that all of the booklets have the same pages, the receiver or the serial number of the booklets to be printed can be changed for each booklet. Therefore, the distribution of the booklets can be conveniently performed and the printed document can be easily controlled.

If the printing apparatus is able to change the contents to be printed for each page similarly to the electrophotographic printer, it can be applied to the printing and binding apparatus according to the present invention.

It is preferred that the electrophotographic printer for use as the printing apparatus according to the present invention is a printer capable of printing 10 wide paper sheet. As a printer capable of printing wide printing paper, Zerox Copy Flow 24C printer capable of printing 24-inch wide paper sheets has been realized (see ELECTROPHOTOGRAPHY, THE FOCAL PRESS, p. 137, R. M. Schaffert). If an electrophotograhic printer capable of printing 27-inch wide printing paper is used, three A4-booklets, which can be included within 9-inch. width, can be simultaneously printed, and six A5-booklets can be printed simultaneously if the same printing sheets can be used. Therefore, the printing throughputs can be respectively tripled and sextupled. If a wide width printer is used to print small printing paper having a size of A5 or A6 or the like, the printing paper can be undesirably wound around the photoconductive drum or it is jammed at an intermediate passage in the printer. The lost time generated due to the interruption of the process caused from the trouble will finally raise the cost of the product, that is, the booklets. In this viewpoint, the application of the present invention is able to reduce the cost. The aforesaid trouble can be substantially prevented if image information is printed on continuous paper such as a rolled paper, the area of which can be widely used and if the paper cutting process is performed after the printing operation has been completed.

Figure 19:
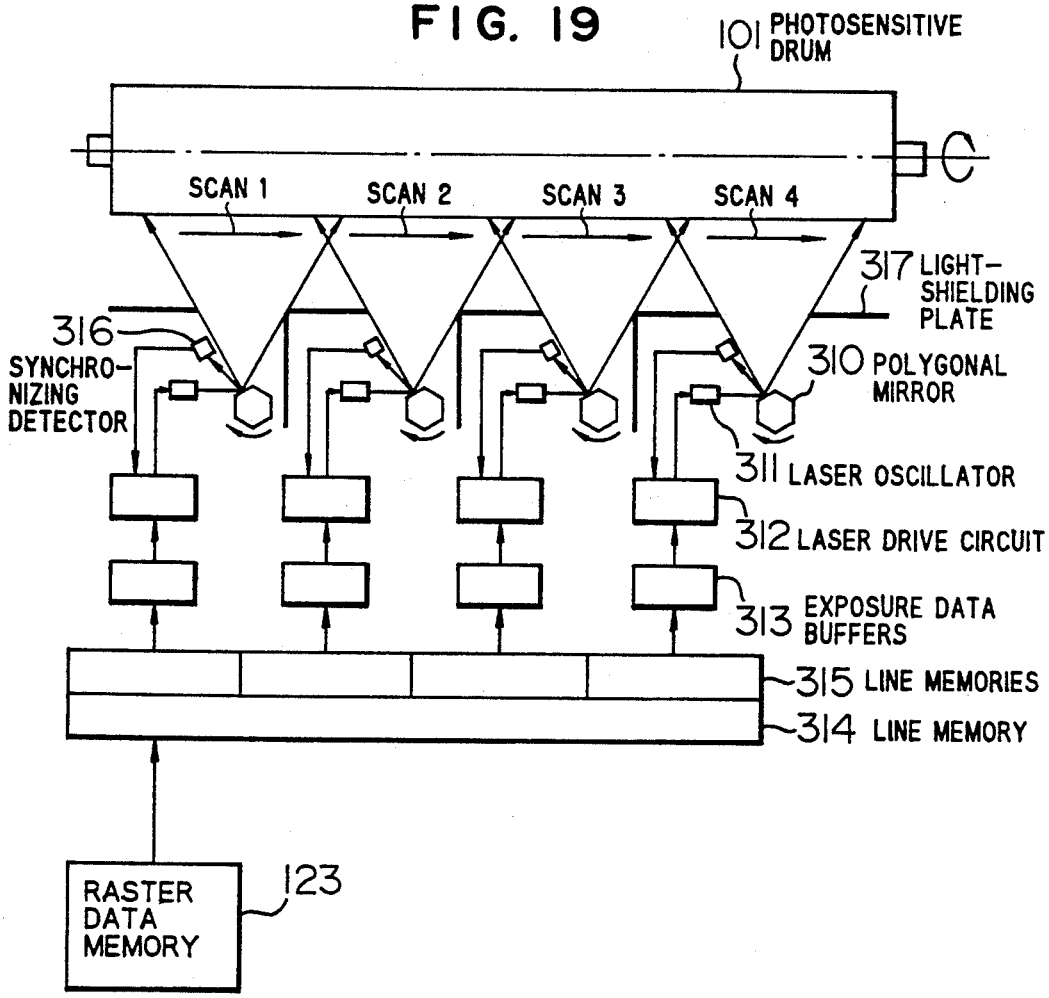
FIG. 19 illustrates an example of a printer which uses a wide photosensitive member according to the present invention.
Figure 20:
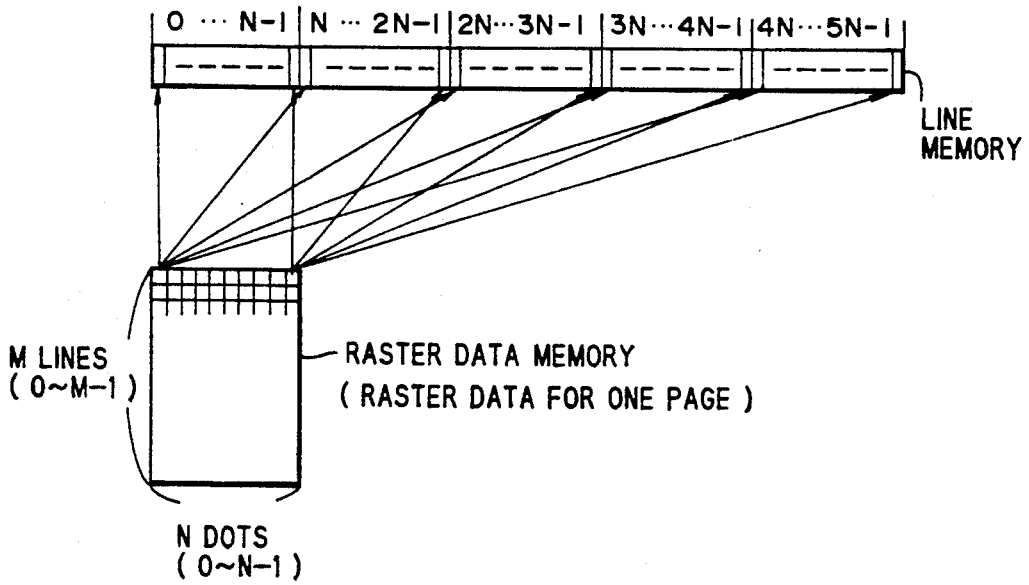
FIG. 20 illustrates the structure of image information to be used to expose the wide photosensitive member to light.

FIG. 19 is a structural view which illustrates a printer which uses the wide photoconductive member. Raster data for one page is, as image information data, 10 received by a raster data memory 123, the raster data for a line being then sequentially transmitted to a line memory 314 and temporarily stored by line memories 315 sectioned to correspond to exposure units each comprising a laser drive circuit 312, a laser oscillator 311, a polygonal mirror 310, a synchronizing detector 316 and a light-shielding plate 317. The stored raster data is then transmitted to data buffers 313 for the corresponding exposure units, and modulated by corresponding laser drive circuits 312. Therefore, a laser oscillator 311 is actuated, and the surface of a photosensitive drum 101 is sectioned and exposed to light while being overlapped by the required width of the photoconductive member. The reason why the exposure is performed in the overlapped manner is that image data to be exposed to light on the photosensitive member must be freed from a seam. Therefore, the quantity of the exposure for the overlapped exposed portion must be so adjusted to prevent excessive exposure. The synchronizing detector 316 acts to introduce a portion of laser beams reflected by the polygonal mirror 310 so as to synchronize the operation timing of a plurality of the exposure units. Although FIG. 19 mainly illustrates the exposure system, developers and the like are, as shown in FIG. 4, disposed in the longitudinal direction of the photoconductive drum by the same number as that of the exposure units. A fixer having the same length as that of the photoconductive drum is disposed. FIG. illustrates the relationship between the raster data memory 123 and the line memory 315 shown in FIG. 20. The raster data memory 123 stores data for M lines as data of each dot for each line. The line memory 315 has a line feeding mark, with which the line feeding can be recognized for each line, added thereto. By constituting image information as described above, the conditions for exposing the wide photoconductive member can be determined.

Figure 21:
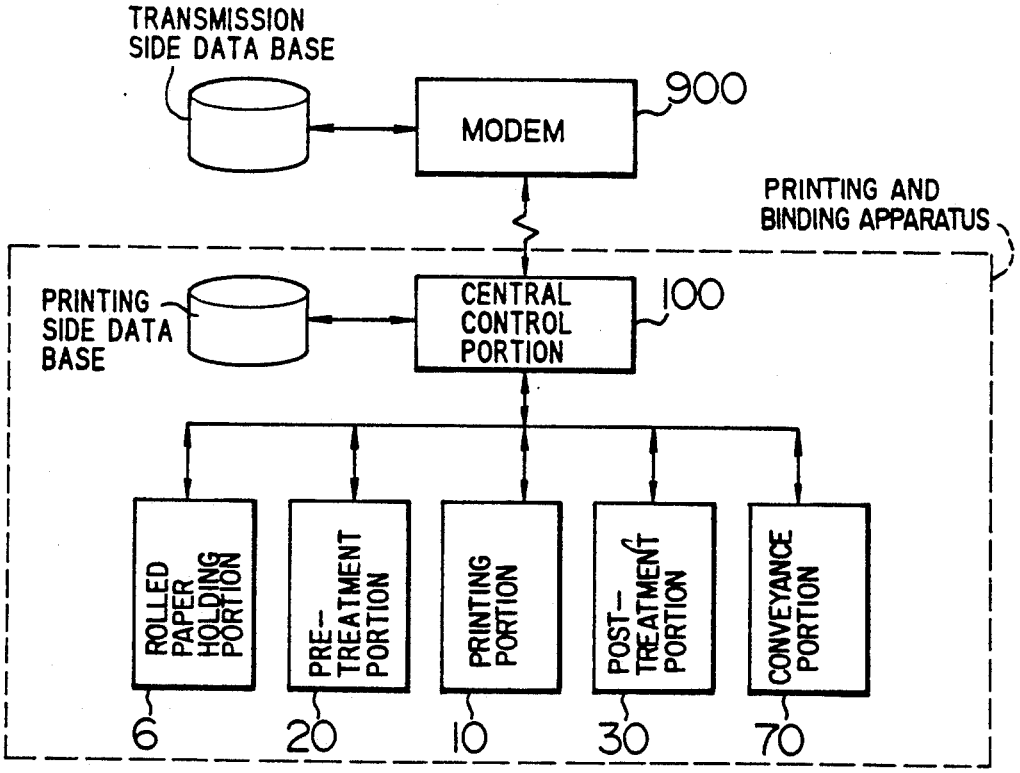
FIG. 21 illustrates an example of a printing and binding system according to the present invention.

FIG. 21 illustrates an embodiment in which information communication function is added to the aforesaid printing and binding apparatus so as to be applied to a booklet supply system. The booklets are supplied from or supplied to bookstores, business organizations, the head office or the branch offices of a newspaper office, the head office or the branch offices of a public agency, and the editorial department or its branch offices of a magazine publishing company. By transmitting and receiving image information by a communication means, for example, a narrow or a wide network ( such as a local area network ), a public line ( a present telephone line, the ISDN, a wide area ISDN) or a satellite communication line, desired information of a book or a booklet can be obtained from user's place. The difference from the conventional facsimile apparatus lies in the operation and effect in that printed and bound booklets can be, as an alternative to transmitting/receiving image information as information in paper units, supplied by a large quantity even if the number of the types of the booklets is very small. By constituting a data base about basic information, which is the base of image information to be printed, and by collecting, as information to be transmitted/received, enlivened information, which matches the situation of the society which is being changed as well as image information to be printed and additional information relating the subject printing operation (printing state data and/or trouble data), the system according to the present invention can be further actively used. For example, collected data can be edited and issued as a book at proper timing or past information can be retrieved so as to issue a book in which the change of times is considered.

According to the present invention, a plurality of booklets are simultaneously printed and bound in the printing and book binding process in which image information is printed on a paper sheet and booklets are bound so that an effect is obtained in that a required number of booklets can be obtained in a short time.

What is claimed is:

1. A printing and binding method for printing a plurality of images on printing paper to make booklets by using an electrophotographic recording apparatus, the printing and binding method comprising:

a printing step in which a first printing operation is conducted to print image information items of the number, which corresponds to the number of booklets which can be printed simultaneously, on predetermined ares of one printing paper sheet for one of the total pages to be contained in each booklet, and said first printing operation is followed by succeeding printing operations on predetermined areas of other printing paper sheets for the rest of the total pages of said booklet so as to print said pages of the booklet which correspond to the contents of the image information of said booklet so that booklets to be bound are printed each of the predetermined areas of each printing paper sheet corresponding to one of the pages of each booklet, the image information items to be printed on the predetermined areas of each of the printing paper sheets being identical with each other, the predetermined areas of respective printing paper sheets being disposed in substantially the same arrangement;

a separation step in which the areas of respective printing paper sheets printed in said printing step are simultaneously separated from one another at boundaries of said number of booklets to form stacks of the thus separated area of the printing paper sheets; and a binding step in which the separate areas of each stack are bound to form a booklet.

2. A printing and binding method according to claim 1, wherein said printing step is carried out such that said pages of said booklets which correspond to the contents of said image information of said booklet are printed in a page decreasing order or a page increasing order.

3. A printing and binding method according to claim 1, wherein said printing step is carried out such that, if booklets of a number which is larger than the pages disposed in one printing paper sheet are printed by a electrophotographic method and bound, printing data for one booklet is dot-developed and stored in storage means at the first printing operation, and said stored data is used to perform printing in the succeeding printing operations.

4. A printing and binding method according to claim 1, wherein said printing step is carried out such that rolled paper is used and cut into printing paper sheets in each of which a plurality of the same pages of said booklets are disposed in the same widthwise direction of said rolled paper while being freed from overlap, and said pages of said booklets are printed on said printing paper sheets in the sequential order of said pages of said booklet while making the sides of said booklets in the same direction as a direction in which said rolled paper is fed to be boundaries, and said separation step is carried out such that the thus printed paper sheets are cut at said boundaries to form pages for the booklets to be made, pages for one booklet are gathered after said pages have been printed, and the thus gathered pages are bound to make the one booklet.

5. A printing and binding method for making booklets by printing a plurality of image information items, on printing paper sheets and by using an electrophotographic recording apparatus, said printing and binding method comprising:

a printing information and disposition determining step in which the size of the pages of each booklet, the number of said booklets to be printed and image information items of each page of said booklet are inputted so as to determine the size of each printing paper sheet to be loaded into the apparatus and the arrangement of said image information items to be printed;

a cutting step in which said rolled paper is, in accordance with said determined arrangement, cut into printing paper sheets having the thus determined size;

a printing step in which a first printed operation is conducted to print image information items of the number, which corresponds to the number of booklets which can be printed simultaneously, on predetermined areas of one printing paper sheet which are disposed in said determined arrangement, said printing operation is followed by succeeding printing operations on predetermined areas of other printing paper sheets for the rest of the total pages of said booklet so as to print the contents of the image information of said booklet so that booklets to be bound are printed, each of the predetermined areas of each printing paper sheet corresponding to one of the pages of each booklet;

a separation step in which the areas of respective printing paper sheets printed in said printing step are simultaneously separated one from another at boundaries of pages of said booklets to form stacks of the thus separated areas of the printing paper sheets; and a binding step in which the separated areas of each stack are bound to form a booklet.

6. A printing and binding method according to claim 5, wherein said printing step is carried out such that, if booklets of a number which is larger than the pages disposed in one printing paper sheet are printed by said electrophotographic recording apparatus and bound, printing data for one booklet is dot-developed and stored in storage means at the first printing operation, and said stored data is used to perform printing in the succeeding printing operations.

7. A printing and binding method according to claim 5, wherein said printing information and disposition determining step includes a further step in which said areas of each printing paper sheet are so arranged in said printing paper sheet that, before and during said cutting step, no intersection is formed solely by cutting lines each of which has at least either end spaced inwardly from an outer periphery of said printing paper sheet.

8. In a printing and binding apparatus comprising paper supply means for supplying printing paper sheets, means for inputting image information, and printing means which uses an electrophotographic recording apparatus for printing the thus input image information on the printing paper sheets, and means for cutting and binding printed recording paper sheets to form booklets, for the improvement comprising:

printing information arrangement determining means including input means for inputting the number of booklets, the size of said printing paper sheet and the size of each page to be printed, and image information arrangement determining means for determining the arrangement of said image information to be printed in accordance with a variety of the information items;

printing means including a photosensitive drum, a plurality of exposure units disposed in the lengthwise direction of said photosensitive drum, a plurality of development units for developing electrostatic latent images formed by said exposure units, a plurality of transfer units for transferring images developed by said development units onto said printing paper sheets, and a fixing unit for fixing said image transferred onto said printing paper sheets;

separation means for simultaneously cutting, in accordance with the thus input size of the page, the printed printing paper sheets of the number corresponding to the number of page to be contained in each of said booklets to form a plurality of stacks of the thus separated printed recording sheets; and binding means for binding said stacks of separated printed recording sheets, respectively.

9. A printing and binding apparatus according to claim 8, wherein said exposure means has a structure which is able to expose adjacent exposure regions.

10. A printing and binding apparatus according to claim 8, wherein said paper supplying means includes cutting means for cutting rolled paper into sheets each having a size of each page to be printed, said cutting means including paper leading portion detection means movable in a direction in which said rolled paper is supplied, and a cutting unit disposed upstream of said paper leading portion detection means as viewed in the direction in which said rolled paper is supplied and being capable of cutting said rolled paper in a direction perpendicular to the direction in which said rolled paper is supplied, to cut said rolled paper in accordance with the arrangement determined by said printing information arrangement determining means.

* * * * *